US006024550A

United States Patent [19]

Miyazaki et al.

[11] Patent Number: 6,024,550

[45] Date of Patent: Feb. 15, 2000

[54] ROTARY TOOTHED OIL PUMP HAVING ROTOR POSITIONING PROTRUSIONS

[75] Inventors: Hisashi Miyazaki, Anjyo; Yoshinori Miura, Kariya, both of Japan

[73] Assignee: Aisin Seiki Kabushiki Kaisha, Aichi-pref., Japan

[21] Appl. No.: 08/921,269

[22] Filed: Aug. 29, 1997

[30] Foreign Application Priority Data

Aug. 30, 1996 [JP] Japan ..... 8-230779

[51] Int. Cl.[7] ..... F04C 2/10

[52] U.S. Cl. ..... 418/171

[58] Field of Search ..... 418/166, 170, 418/171

[56] References Cited

U.S. PATENT DOCUMENTS

| | | | |
|---|---|---|---|
| 2,694,367 | 11/1954 | Seavey | 418/170 |
| 5,314,319 | 5/1994 | Nilsson et al. | 418/171 |

FOREIGN PATENT DOCUMENTS

| | | | |
|---|---|---|---|
| 4203256 | 8/1992 | Germany | 418/171 |
| 61-223282 | 10/1986 | Japan | 418/171 |
| 63-195391 | 8/1988 | Japan | 418/171 |
| 63-22382 | 9/1988 | Japan . | |
| 2187233 | 9/1987 | United Kingdom | 418/171 |

*Primary Examiner*—John J. Vrablik

*Attorney, Agent, or Firm*—Reed Smith Hazel & Thomas LLP

[57] ABSTRACT

An oil pump of the type which includes a pump housing formed with an axial bore for support of an input shaft and a cylindrical recess the center of which is eccentrically displaced from the center of the axial bore, an inner rotor formed at its inner periphery with at least a pair of diametrically opposed radial projections for engagement with the input shaft disposed in the axial bore and at its outer periphery with a plurality of external teeth and being mounted on the input shaft within the pump housing for rotation therewith in a condition where opposite side faces of the inner rotor are slidable in contact with a pair of axially opposed internal side faces of the pump housing, and an outer rotor formed at its inner periphery with a plurality of internal teeth for engagement with the external teeth of the inner rotor and being coupled within the cylindrical recess of the pump housing, wherein the diametrically opposed radial projections of the inner rotor are integrally formed at their one ends with an axial protrusion respectively to be coupled with the axial bore of the pump housing for positioning the inner rotor in place without causing any frictional contact therewith.

4 Claims, 5 Drawing Sheets

ROTARY TOOTHED OIL PUMP HAVING ROTOR POSITIONING PROTRUSIONS

BACKGROUND OF THE INVENTION

1. Field of the Invention

The present invention relates to an oil pump of the type which includes an outer rotor contained within a pump housing and an inner rotor coupled within the outer rotor and mounted on an input shaft for rotation therewith.

2. Description of the Prior Art

Disclosed in Japanese Patent Laid-open Publication No. 63(1988)-223382 is an oil pump of the type which includes a pump housing, an inner rotor formed at its inner periphery with a pair of diametrically opposed radial projections for engagement with an input shaft and at its outer periphery with a plurality of external teeth and being mounted on the input shaft within the pump housing for rotation therewith in a condition where opposite side faces of the inner rotor are slidable in contact with a pair of axially opposed internal side faces of the pump housing, and an outer rotor formed at its inner periphery with a plurality of internal teeth for engagement with the external teeth of the inner rotor and being coupled within a cylindrical recess formed in the pump housing for rotation about a rotation center eccentrically displaced from the rotation center of the inner rotor. In the oil pump, the inner rotor is formed at one side of the radial projections thereof with a cylindrical protrusion which is coupled within an axial bore in the pump housing.

Although the cylindrical projection of the inner rotor is useful to position the inner rotor in place, sliding engagement of the cylindrical projection with an inner periphery of the bore in the pump housing results in an increase of torque loss of the oil pump. In addition, it is required to form an annular sealing surface on one side of the inner rotor at the outer periphery of the cylindrical projection. As a result, the inner rotor is enlarged in diameter, causing an increase of torque loss of the oil pump.

SUMMARY OF THE INVENTION

It is, therefore, a primary object of the present invention to provide an oil pump capable of overcoming the problem discussed above.

According to the present invention, the object is accomplished by providing an oil pump of the type which includes a pump housing formed with an axial bore for support of an input shaft and a cylindrical recess the center of which is eccentrically displaced from the center of the axial bore, an input shaft disposed in the axial bore of the pump housing, an inner rotor formed at its inner periphery with at least a pair of diametrically opposed radial projections for engagement with the input shaft and at its outer periphery with a plurality of external teeth and being mounted on the input shaft within the pump housing for rotation therewith in a condition where opposite side faces of the inner rotor are slidable in contact with a pair of axially opposed internal side faces of the pump housing, and an outer rotor formed at its inner periphery with a plurality of internal teeth for engagement with the external teeth of the inner rotor and being coupled within the cylindrical recess of the pump housing, wherein the diametrically opposed radial projections of the inner rotor are integrally formed at their one ends with an axial protrusion respectively to be coupled with the axial bore of the pump housing for positioning the inner rotor in place.

In the case that the inner rotor is formed at its inner periphery with a plurality of internal spline teeth for engagement with a plurality of external spline teeth formed on the input shaft, the internal spline teeth of the inner rotor each are integrally formed at their one ends with an axial protrusion to be coupled with the axial bore of the pump housing for positioning the inner rotor in place.

BRIEF DESCRIPTION OF THE DRAWINGS

Other objects, features and advantages of the present invention will be more readily appreciated from the following detailed description of preferred embodiments thereof when taken together with the accompanying drawings, in which.

DESCRIPTION OF THE PREFERRED EMBODIMENTS

Figure 1:
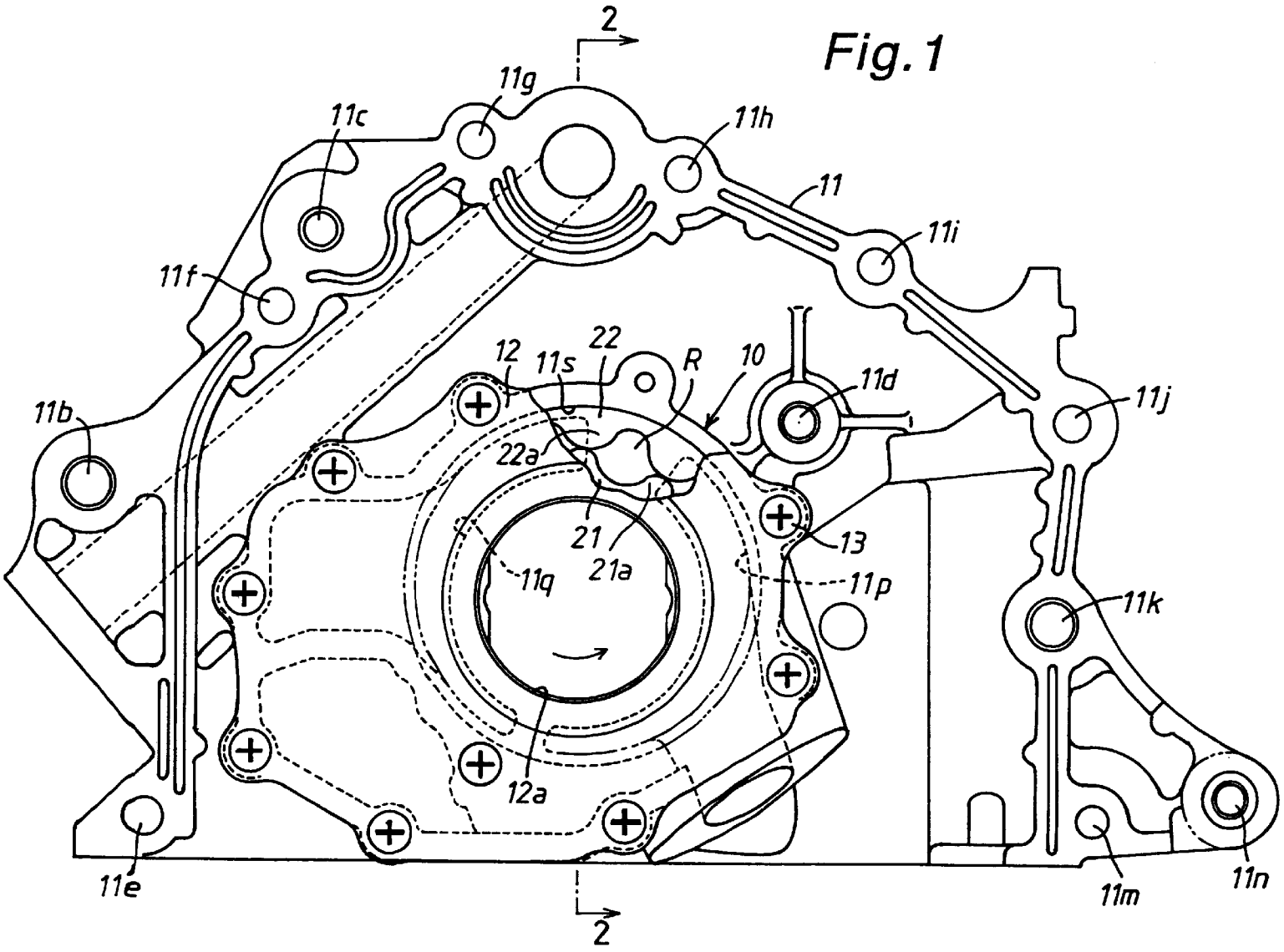
FIG. 1 is a rear view of an embodiment of an oil pump in accordance with the present invention.
Figure 2:
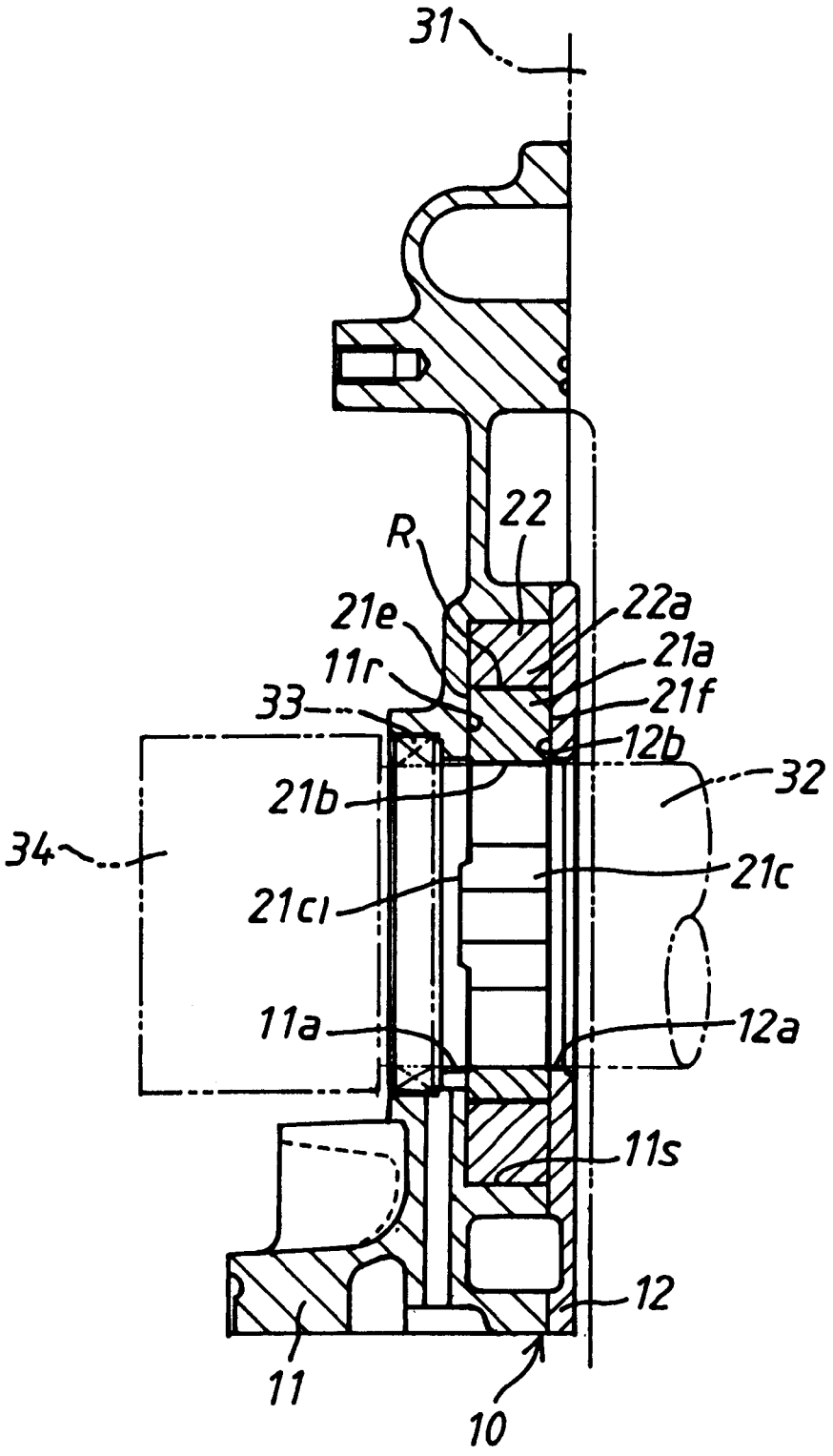
FIG. 2 is a vertical sectional view of the oil pump taken along line 2—2 in FIG. 1.

In FIGS. 1–5 of the drawings, there is illustrated a preferred embodiment of an oil pump in accordance with the present invention which includes a pump housing 10 and inner and outer rotors 21 and 22 assembled within the pump housing 10. As shown in FIG. 2, the oil pump is mounted to an engine block 31 to be driven by a crankshaft 32 of an internal combustion engine. The crankshaft 32 is provided thereon with an annular oil seal 33 and a crank pulley 34 for driving a timing belt (not shown). The oil pump is assembled by mounting a cover plate 12 to a body structure 11 of pump housing 10 after the inner and outer rotors 21 and 22 have been assembled within the body structure 11.

The cover plate 12 is mounted to the body structure 11 of pump housing 10 by means of dish screws 13. The body structure 11 and cover plate 12 are formed with coaxial bores 11*a* and 12*a* respectively for support of the crankshaft 32. The body structure 11 of pump housing 10 is formed with laterally spaced pin holes 11*b* and 11*k* for engagement with positioning pins (not shown) inserted therethrough when the oil pump is mounted to the engine block, mounting holes 11*c*–11*m* for engagement with mounting bolts (not shown) inserted therethrough for mounting the body structure 11 of pump housing 10 to the engine block 31, and a screw hole 11*n* for mounting an accessory member (not shown) to the body structure 11 of pump housing 10. The body structure 11 of pump housing 10 is formed therein with semi-circular suction and discharge ports 11*p* and 11*q*.

Figure 3:
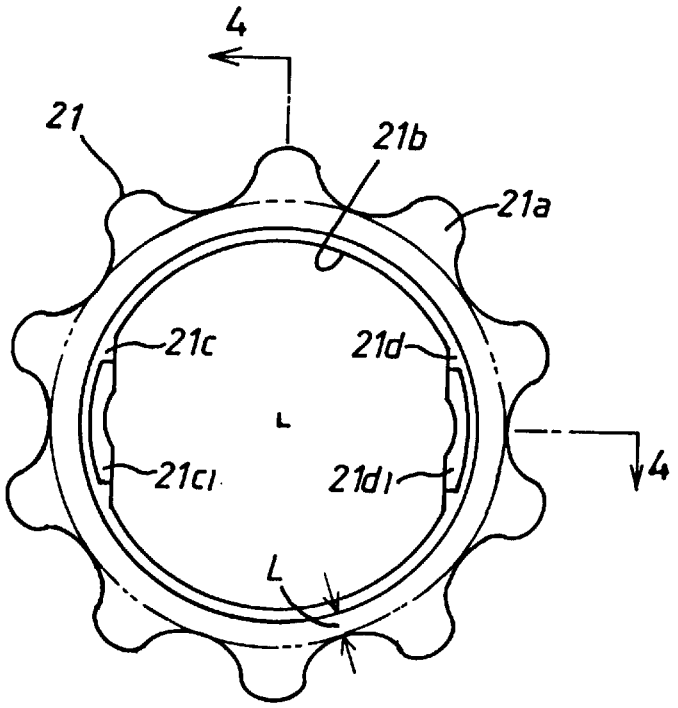
FIG. 3 is a front view of an inner rotor shown in FIGS. 1 and 2.
Figure 4:
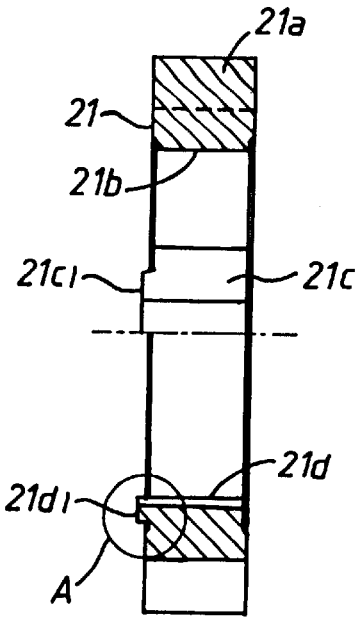
FIG. 4 is a sectional view taken along line 4—4 in FIG. 3.
Figure 5:
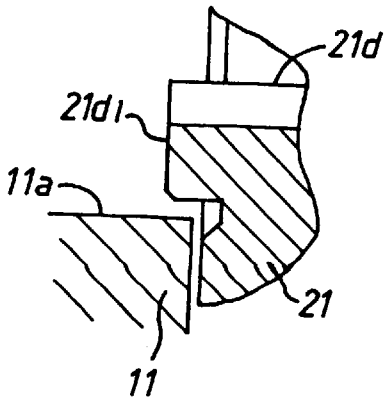
FIG. 5 is an enlarged sectional view of a portion shown by the character A in FIG. 4.

As shown in FIGS. 3 and 4, the inner rotor 21 is formed with a plurality of external teeth 21*a* at its outer periphery and formed with an axial bore 21*b* for engagement with the crankshaft 32. The axial bore 21*b* is formed at its inner periphery with a pair of diametrically opposed radial projections 21*c* and 21*d* which are each formed with a flat surface respectively for engagement with a pair of flat surfaces formed on opposite sides of the crankshaft 32. The inner rotor 21 is positioned in slidable engagement with a pair of opposed internal side faces 11*r*, 12*b* of the pump housing 10 at its opposite side faces 21*e*, 21*f* in a condition where it has been mounted on the crankshaft 32. The annular surfaces between the inner peripheries of the side faces 21*e*, 21*f* and the flank circle of external teeth 21*a* are each formed as a sealing surface of width L as shown in FIG. 3.

As shown in FIG. 1, the outer rotor 22 has a plurality of internal teeth 22*a* formed at its inner periphery to be successively engaged with the external teeth 21*a* of inner rotor 21 so that a plurality of pump chambers R are formed between the internal and external teeth 21*a* and 22*a*. The outer rotor 22 is coupled within a cylindrical recess 11*s* in the body structure 11 of pump housing 10 to be rotated by engagement with the inner rotor 21 about a rotation center eccentrically displaced in a predetermined distance from the rotation center of inner rotor 21.

In this embodiment, it is to be noted that as shown in FIGS. 2 and 4, the diametrically opposed radial projections 21*c* and 21*d* of inner rotor 21 are integrally formed at their one ends with axial protrusions 21*c*1 and 21*d*1 to be coupled with the axial bore 11*a* in the body structure 11 of pump housing 10. The axial protrusions 21*c*1, 21*d*1 are formed slightly smaller in diameter than the axial bore 11*a* to avoid frictional contact with the inner surface of axial bore 11*a* during rotation of the inner rotor 21. With such an arrangement of the axial protrusions 21*c*1, 21*d*1 integral with the radial projections 21*c*, 21*d*, the annular sealing surface at the one side of the inner rotor 21 can be formed in the predetermined width L to avoid an increase of torque loss of the inner rotor 21 caused by sliding engagement with the body structure 11 of pump housing 10, and the inner rotor 21 can be assembled in position within the body structure 11 of pump housing 10 in a simple manner.

Figure 6A:
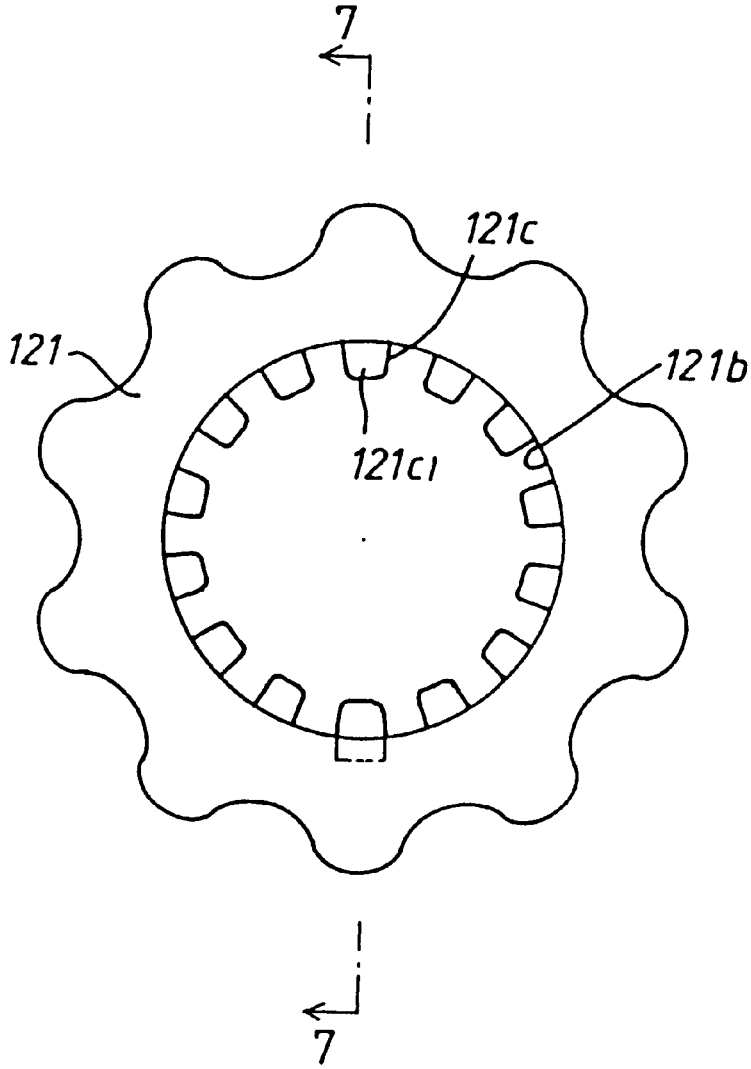
FIG. 6*a* is a front view of a modification of the inner rotor shown in FIG. 3.
Figure 7:
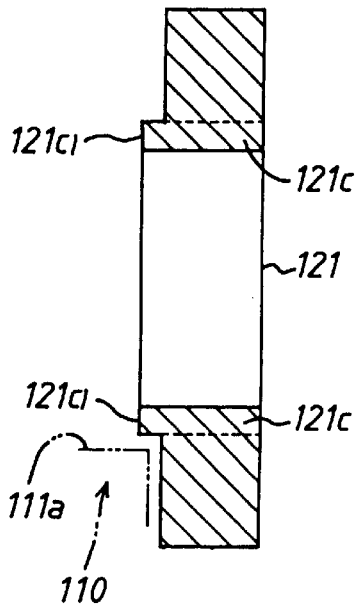
FIG. 7 is a sectional view taken along line 7—7 in FIG. 6.

Although in the above embodiment, the inner rotor 21 has been engaged at its internal radial projections 21*c*, 21*d* with the opposite flat surfaces of crankshaft 32 to be applied with drive torque from crankshaft 32, the present invention may be adapted to an oil pump of the type wherein as shown in FIGS. 6*a* and 7, an inner rotor 121 is formed at its axial bore 121*b* with a plurality of internal spline teeth 121*c* for engagement with a plurality of external spline teeth (not shown) formed on the crankshaft 32. In such an embodiment, as shown in FIG. 7, the internal spline teeth 121*c* of the inner rotor 121 each are integrally formed at their one ends with an axial protrusion 121*c*1 to be coupled with an axial bore 111*a* in a pump housing structure 110, and the axial protrusions 121*c*1 of internal spline teeth 121*c* are formed slightly smaller in diameter than the axial bore 111*a* to avoid frictional contact with the inner surface of axial bore 111*a* during rotation of the inner rotor 121.

Figure 6B:
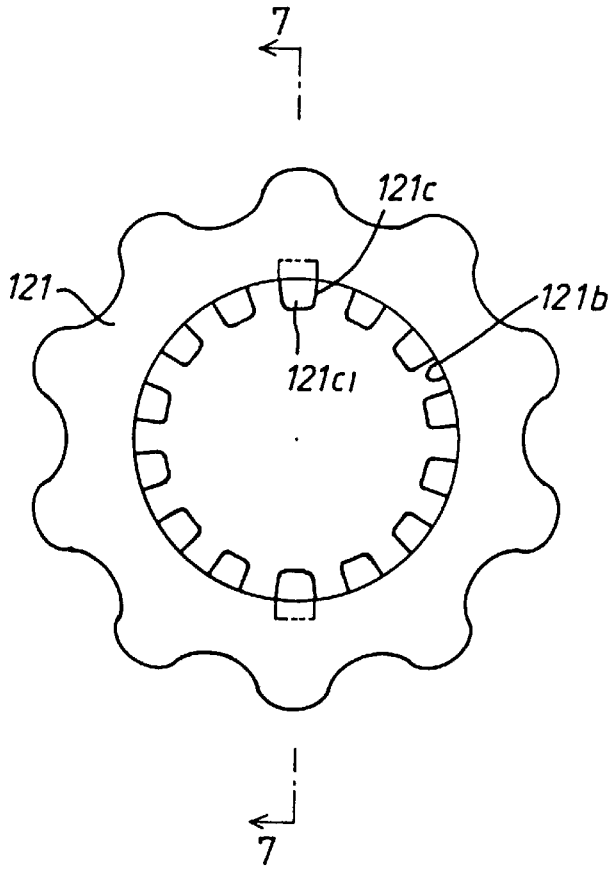
FIG. 6*b* is a front view of a further modification of the inner rotor shown in FIG. 3.

In the embodiment shown in FIGS. 6*a* and 7, the internal spline teeth 121*c* may be replaced with a pair of diametrically opposed keys fixed to the inner rotor 121 with pressfit as shown by imaginary lines in FIG. 6*b*. In such a case, the keys each are integrally formed at their one ends with the axial protrusion 121*c*1.

What is claimed is:

1. An oil pump of the type which includes a pump housing formed with an axial bore for support of an input shaft and with a cylindrical recess the center of which is eccentrically displaced from the center of the axial bore, an inner rotor formed at its inner periphery with at least a pair of diametrically opposed radial projections for engagement with the input shaft disposed in the axial bore and at its outer periphery with a plurality of external teeth and being mounted on the input shaft within the pump housing for rotation therewith in a condition where opposite side faces of the inner rotor are slidably in contact with a pair of axially opposed internal side faces of the pump housing, and an outer rotor formed at its inner periphery with a plurality of internal teeth for engagement with the external teeth of the inner rotor and being coupled within the cylindrical recess of the pump housing, wherein the diametrically opposed radial projections of said inner rotor each are integrally formed at their one ends with an axial protrusion slightly smaller in diameter than the axial bore of the pump housing to be coupled within the axial bore of said pump housing for positioning said inner rotor in place without causing any frictional contact with the inner peripheral surface of the axial bore during rotation of the inner rotor.

2. An oil pump as recited in claim 1, wherein the diametrically opposed radial projections of said inner rotor are each formed with a flat surface respectively for engagement with a pair of flat surfaces formed on opposite sides of said input shaft.

3. An oil pump as recited in claim 1, wherein the diametrically opposed radial projections of said inner rotor are in the form of a plurality of internal spline teeth formed on the inner periphery of said inner rotor for engagement with a plurality of external spline teeth formed on said input shaft, and wherein the internal spline teeth of said inner rotor each are integrally formed at their one ends with an axial protrusion to be coupled with the axial bore of said pump housing for positioning said inner rotor in place without causing any frictional contact therewith.

4. An oil pump as recited in claim 1, wherein the diametrically opposed radial projections of said inner rotor are in the form of a pair of diametrically opposed keys fixed to said inner rotor for engagement with said input shaft, and wherein said keys each are integrally formed at their one ends with an axial protrusion to be coupled with the axial bore of said pump housing for positioning said inner rotor in place without causing any frictional contact therewith.

* * * * *